US006360972B1

(12) United States Patent
Fuseya et al.

(10) Patent No.: US 6,360,972 B1
(45) Date of Patent: Mar. 26, 2002

(54) SWITCHING VALVE

(75) Inventors: Tsutomu Fuseya, Yokohama; Mahoro M. Fujita, Tokyo, both of (JP); Hermann Breitbach, Crauthem, Luxembourg (LU)

(73) Assignees: Delphi Technologies, Inc., Troy, MI (US); Isuzu Motors, Ltd. (JP)

( * ) Notice: Subject to any disclaimer, the term of this patent is extended or adjusted under 35 U.S.C. 154(b) by 0 days.

(21) Appl. No.: 09/543,914

(22) Filed: Apr. 6, 2000

(30) Foreign Application Priority Data

Apr. 7, 1999 (DE) ..... 199 15 686

(51) Int. Cl.[7] ..... B05B 1/30; F02M 51/00

(52) U.S. Cl. ..... 239/585.3; 239/88; 239/96; 239/533.9; 239/900; 251/129.16

(58) Field of Search ..... 239/533.2, 533.3, 239/533.8, 533.9, 585.1, 585.3, 96, 88, 980; 251/129.16, 129.21

(56) References Cited

U.S. PATENT DOCUMENTS

| | | | | |
|---|---|---|---|---|
| 5,154,350 A | * | 10/1992 | Ausiello et al. | 239/585.3 X |
| 5,244,150 A | * | 9/1993 | Ricco et al. | 239/585.3 X |
| 5,348,233 A | * | 9/1994 | Press et al. | 239/585.3 |
| 5,984,264 A | * | 11/1999 | Ricco | 251/129.16 |
| 6,119,966 A | * | 9/2000 | Wagner et al. | 239/585.1 X |
| 6,131,829 A | * | 10/2000 | Ricco | 239/585.3 X |

* cited by examiner

*Primary Examiner*—Steven J. Ganey
(74) *Attorney, Agent, or Firm*—John VanOphem

(57) ABSTRACT

The invention relates to a switching valve (10) comprising a valve body (20) in which a flow passage (24) is formed which opens with its one end into a work space (42). A valve plate (44) is accommodated in the work space (42) and can be moved between a closure position and an opening position. A closure element (50) is arranged between the valve plate (44) and the opening (26) of the flow passage (24) and closes the latter when the valve plate (44) is located in its closure position.

19 Claims, 1 Drawing Sheet

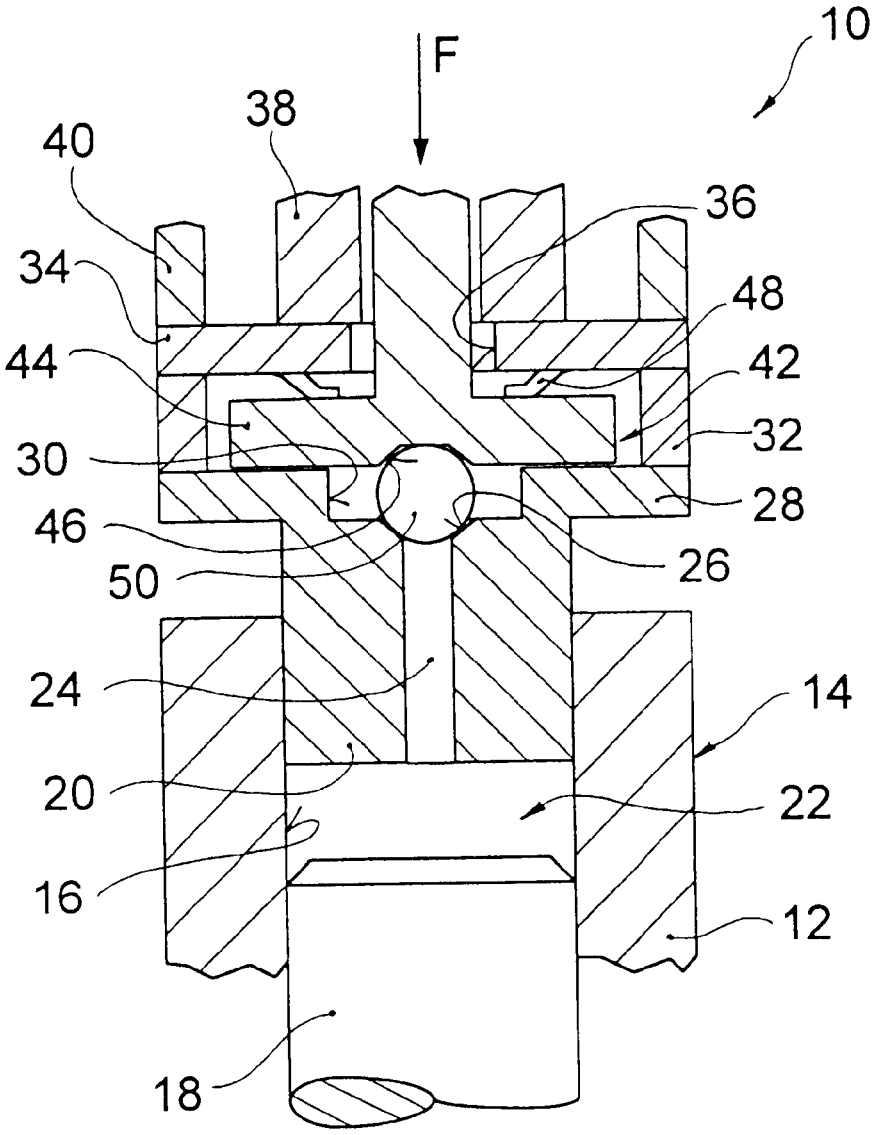
10
F
38
40
36
34
48
44
42
32
30
28
46
26
50
24
14
20
22
16
12
18

SWITCHING VALVE

TECHNICAL FIELD

The present invention relates to a switching valve, in particular for the actuation of an injection valve in an internal combustion engine, comprising a valve body in which a flow passage is formed which opens with one end into a work space, and comprising valve plate which is accommodated in the work space and which can be moved between a closure position and an opening position. The invention further relates to an injection valve with a switching valve of this kind.

BACKGROUND OF THE INVENTION

A switching valve of this kind is known and is used in particular for the actuation of valves, such as for example injection valves in internal combustion engines. For this purpose the switching valve has a flow passage, the one end of which can be connected to a pressure chamber of the valve to be actuated. The other end of the flow passage opens into a work space which is provided at the switching valve and in which a valve plate is arranged for the closing off of the flow passage. The valve plate can be moved back and forth between a closure position and an opening position. Through opening of the flow passage the pressure chamber of the valve to be actuated can for example be connected to an outflow line or to the surroundings.

The known switching valve is used in an injection valve in a diesel engine in order to be able to determine the injection moment and the injection duration of the fuel to be injected through the injection valve. For the closing of the injection nozzle of the injection valve a nozzle needle is provided which is displaceably journalled in a needle guide and which is hydraulically clamped in such a manner in between the injection nozzle and the pressure chamber to which to the flow passage of the switching valve is connected that the nozzle needle holds the injection nozzle closed. Through opening of the flow passage the fluid which is located in the pressure chamber depresses so that the nozzle needle opens the injection nozzle. After the closing of the flow passage, pressure builds up again in the interior of the pressure chamber, through which the nozzle needle is again moved into its position which closes the injection nozzle.

SUMMARY OF THE INVENTION

The object of the invention is to provide a switching valve or, respectively, an injection valve with a switching valve of this kind which or, respectively, in which the switching valve is simple to manufacture and seals off the flow passage correctly with simple means.

This object is satisfied in a switching valve of the initially named kind in that a closure element is arranged between the valve plate and the opening of the flow passage and closes the latter when the valve plate is located in its closure position.

In the switching valve in accordance with the invention the opening of the flow passage is closed off by the separate closure element which is provided between the valve plate and the opening of the flow passage. If the valve plate is moved into the opening position, the closure element lies in contact at the opening of the flow passage without a bias force so that the fluid can flow past the closure element out of or into the flow passage respectively. If the valve plate is again moved into its closure position, it takes along with it the closure element, which in turn aligns itself at the opening of the flow passage and closes off the latter as soon as the valve plate has arrived at its final closure position. Since the closure element can move relative to the valve plate, an exact guiding and positioning of the valve plate relative to the opening of the flow passage is no longer required, so that both the valve plate and the guide for the valve plate need to be manufactured less precisely than in the known switching valves. At the same time it is achieved through the freedom of movement of the closure element relative to the opening of the flow passage that the closure element is moved by the inflowing or outflowing fluid respectively into a position in which it lies uniformly in contact at the opening and correctly seals off the latter as soon as it is pressed by the valve plate against the opening and closes off the latter.

Advantageous further developments of the invention can be taken from the description, from the drawings and from the subordinate claims.

Thus it is particularly advantageous to use a valve ball as a closure element which lies in contact at the opening in the shape of a line through its ball shape in every position relative to the opening of the flow passage.

In order that the closure element is also held in a definite position relative to the opening of the flow passage when the valve plate is in its opening position, the valve plate preferably has a recess for the closure element which is aligned with the opening of the flow passage. In order to hold the closure element better in the recess and the opening it is further proposed to form the recess and/or the opening conically. The depth of the opening is greater than the stroke of the valve plate. The closure element, for example a ball, is thereby held in the opening. At the same time the closure element can move parallel to the valve plate in the opening so that it can center itself in the opening. Through the conical cross-sectional form of the recess or of the opening respectively it is achieved that the closure element lies uniformly in contact at the wall of the recess and is held in a definite position. A conical recess and an opening which is provided with a conical sealing surface is suitable in particular in the use of a valve ball as closure element, which, as a result of its surface curvature, conforms particularly well to the walls of the recess and of the opening, which extend at an inclination.

In a particularly preferred embodiment of the switching valve in accordance with the invention, resilient elements which are secured at the valve plate and which guide the latter are provided at the inner surface of the work space which faces the flow passage so that a dislocation of the valve plate transversely to its direction of movement is prevented. Through the resilient elements the valve plate is held in a definite position without it being necessary for the valve plate to be guided precisely.

The valve plate is preferably held in its closure position by a compression spring and is moved by means of an actuator into its opening position, since it is thus ensured that the switching valve remains closed in the event of a dropout of the actuator.

In a preferred embodiment of the switching valve in accordance with the invention the work space is bounded by a one or more piece valve body, a ring which lies in contact at the valve body and a disc which lies in contact at the latter. Through the choice of the material thickness of the disc, when a magnet is used as an actuator, the holding force of the magnet can be influenced if the latter is arranged at the surface of the disc which faces away from valve plate since the material thickness of the disc determines the distance of the valve disc from or the air gap of the valve disc to the magnet respectively.

The geometry of the valve body is preferably dimensioned in such a manner that the valve plate lies sealingly in its closure position at the closure element which projects out of the passage opening when it closes off the opening of the flow passage, without however lying in contact at the valve body, so that a gap remains between the valve plate and the valve body. Through this it is ensured that the entire closure force of the valve plate is transmitted exclusively to the closure element, through which a particularly good sealing action can be achieved. Moreover, in the closure movement of the valve plate the fluid must be forwarded out of the gap between the valve plate and the valve body, through which the closure movement of the valve plate is slightly braked and possibly arising oscillatory movements of the valve plate, which arise after the impact onto the closure element through a resilient rebound of the valve plate, are damped.

The above described switching valve can be used in particular in an injection valve for the fuel injection in an internal combustion engine. In this the flow passage is in connection with a needle guide in which a nozzle needle for the closing off of the injection nozzle of the injection valve is displaceably accommodated.

BRIEF DESCRIPTION OF THE DRAWINGS

The present invention will now be described, by way of example, with reference to the accompanying drawings, in which:

FIG. 1 is a sectioned side view of a switching valve in accordance with the invention for the actuation of an injection valve.

DESCRIPTION OF THE PREFERRED EMBODIMENT

The figure shows a switching valve 10 in a sectioned side view. The switching valve 10 is arranged at a holder body 12 of an injection valve 14. A passage bore 16 which ends at the end side of the holder body 12 shown above in the figure is formed in the holder body 12 to extend in its longitudinal direction. A piston 18 which can be moved back and forth along the passage bore 16 and which lies in contact with its one end side (not illustrated) at the end side of a nozzle needle (not illustrated) by means of which the injection nozzle (not illustrated) of the injection valve 14 can be closed off is introduced into the passage bore 16.

The switching valve 10 has a cylindrical valve body 20 which is introduced into the passage bore 16 of the holder body 12. The end side of the valve body 20 pointing into the passage bore 16, the inner periphery of the passage bore 16 and the end side of the piston 18 facing the valve body 20 form a high pressure chamber 22, the purpose of which will be explained later. The high pressure chamber 22 is filled with fuel under high pressure which has arrived into the cavity 22 along the nozzle needle and the piston 18 through the passage bore 16.

In the valve body 20 is formed a flow passage 24 which extends in the longitudinal direction of the former, which is in connection with the high pressure chamber 22 and which ends in a conical sealing surface 26 which is formed at the end side of the valve body 20 illustrated above in the figure and which faces away from the injection valve 14. At the upper end side of the valve body 20 a flange 28 is molded on which projects in the radial direction and in the middle of which is formed a passage opening 30 which is arranged concentrically to the conical sealing surface 26. The flat side of the flange 28 which faces away from the injection valve 14 lies in turn in contact at a ring 32 which is likewise arranged concentrically to the conical sealing surface 26. The ring 32 is covered by a disc 34 which is in the shape of a circular surface and which has a through-going opening 36 in its middle. A ring-shaped magnet coil 38 and a hollow-cylindrical shaped housing 40, which are both arranged concentrically about the opening 36, are provided at the flat side of the second disc 34 which faces away from the injection valve 14.

The flange 28, the ring 32 and the disc 34 bound a work space 42 in which a circular valve plate 44 is accommodated, at the end side of which facing the valve body 20 a recess 46 which has a truncated conical cross-sectional shape and which is directed to the conical sealing surface 26 is formed. Furthermore, a plurality of resilient elements 48 are connected to the rear side of the valve plate 44 and project downwardly from the disc 34 and hold the valve plate 44 in a definite position concentric to the conical sealing surface 26. A valve ball 50 by means of which the flow passage 24 can be closed off is arranged between the recess 46 of the valve plate 44 and the conical sealing surface 26.

The valve plate 44 is held by the force F of a compression spring (not illustrated) in its closure position, in which it lies in contact under a bias force at the valve ball 50 and presses the latter against the conical sealing surface 26 in order that the flow passage 24 is closed off in a fluidtight manner. In order to open the flow passage 24 the valve plate 44, which is manufactured of a ferromagnetic material, can be moved with the help of the magnet coil 38 against the force of the compression spring and the resilient elements 48 into an opening position in which the valve plate 44 and the valve ball 50 are lifted off from the valve body 20. In this the maximum stroke of the valve plate 44, which is predetermined through the height of the ring 32 when viewed in the direction of movement of the valve plate 44, is dimensioned in such a manner that the valve ball 50 can move openly between the recess 46 and the conical sealing surface 26, but however a jumping out of the valve ball 50 out of the recess 46 and out of the conical sealing surface 26 is prevented.

As long as the valve plate 44 is located in its closure position the flow passage 24 is closed off by the valve ball 50, which lies under a bias force at the conical sealing surface 26. It is thereby prevented that the fuel which is located in the high pressure chamber 22 can escape via the switching valve 10, so that the piston 18 remains in its lowered position. In this position the piston 18 holds the nozzle needle in a position in which the latter closes off the injection nozzle, with the nozzle needle being subjected to a bias force against the piston 18 through the pressure, which is present at the injection nozzle, of the fuel which is supplied to the injection valve 14, that is, the nozzle needle is clamped in hydraulically between the high pressure chamber 22 and the injection nozzle.

If the injection control of the engine now actuates the magnet coil 38, the ferromagnetic valve plate 44 moves against the force of the compression spring into its opening position, through which the valve ball 50 is released. The valve ball 50 is lifted off by the pressure acting in the high pressure chamber 22 so that the flow passage 24 is no longer closed off and the fuel which is located in the high pressure chamber 22 flows in through the flow passage 24 into the work space 42, from which it escapes via the opening 36 in the disc 34 into a leakage fuel line. Through the dropping pressure in the high pressure chamber 22 the force which is exerted by the piston 18 on the nozzle needle becomes so low that the nozzle needle is lifted by the fuel at the injection nozzle which is under high pressure and which moves the piston 18 in the direction of the switching valve 10. At the same time the nozzle needle opens the injection nozzle so that the fuel enters into the cylinder of the engine.

As soon as the injection control deactivates the magnet coil 38 the valve plate 44 is again moved by the force of the compression spring and of the resilient elements 48 into its closure position in which it presses the valve ball 50 against the conical sealing surface 26, which closes off the flow passage 24 again. The movement of the valve plate 44 is damped by the fuel which is to be displaced out of the gap between the valve plate 44 and the flange 28 of the valve body 20 and which slows down the closure movement of the valve plate 44, through which a resilient backward movement of the valve plate 44 after the impact onto the valve ball 50 is effectively prevented.

What is claimed is:

1. Switching valve, for the actuation of an injection valve in an internal combustion engine, comprising a valve body (20) in which a flow passage (24) is formed which opens with one end into a work space (42), a valve plate (44) which is accommodated in the work space (42) and which can be moved between a closure position and an opening position, and a closure element (50) arranged between the valve plate (44) and the opening (26) of the flow passage (24) wherein said closer element closes off the opening of the flow passage when the valve plate (44) is located in its closure position, wherein the inner surface of the work space (42) which faces the flow passage (24) includes at least one resilient element (48) secured to the valve plate (44) that subject the valve plate (44) to a bias force in the direction of the flow passage (24) in such a manner that dislocation of the valve plate (44) transverse to its direction of movement is prevented.

2. Switching valve in accordance with claim 1, characterized in that the closure element is a valve ball (50).

3. Switching valve in accordance with claim 1 or claim 2, characterized in that the valve plate (44) has a recess (46) which is directed to the opening (26) of the flow passage (24), with the closure element (50) also being held in the recess (46) and the opening (26) when the valve plate (44) is moved into its opening position.

4. Switching valve in accordance with claim 3, characterized in that at least one of the recess (46) and the opening (26) of the flow passage (24) is conically widened.

5. Switching valve in accordance with claim 3, characterized in that the depth of the recess (46) is greater than the stroke of the valve plate (44).

6. Switching valve in accordance with claim 1, characterized in that the valve plate (44) is held by a compression spring in its closure position and can be moved into its opening position by means of an actuator (38).

7. Switching valve in accordance with claim 6, characterized in that an electrically controlled magnet (38) serves as actuator and the valve plate (44) is at least partly formed of a ferromagnetic material.

8. Switching valve in accordance with claim 7, characterized by a radially projecting flange (28) which is formed at the valve body (20) and which is provided with a passage opening (30) which is oriented concentrically to the opening (26) of the flow passage (24) of the valve body (20), by a ring (32) which is supported with one of its end sides at the flange (28) and at the other end side of which a disc (34) lies in contact which together with the flange (28) and the ring (32) bounds the work space (42) of the switching valve (10).

9. Switching valve in accordance with claim 7, characterized in that the switching valve (10) has a plate lying in contact at the valve body (20) with a passage opening which is oriented concentrically to the opening (26) of the flow passage (24), a ring (32) which lies in contact at the plate and a disc (34) lying in contact at the ring (32), which bound the work space (42).

10. Switching valve in accordance with claim 9, characterized in that the magnet (38) is arranged at the surface of the disc (34) which faces away from the valve plate (44) and the material thickness of which determines the air gap when the valve plate (44) is moved into its opening position.

11. Switching valve in accordance with claim 10, characterized in that the valve body (20) is designed in such a manner that in its closure position the valve plate (44) lies in contact at the closure element (50) which projects out of the passage opening (30) and which closes off the opening (26) of the flow passage (24), with a gap remaining at the same time between the valve plate (44) and the valve body (20).

12. Injection valve for the fuel injection in an internal combustion engine in combination with the switching valve of claim 1, the injection valve comprising a holder body (12) and a nozzle body of an injection nozzle secured to the latter, a nozzle needle for the closing off of the injection nozzle and movable in a needle guide (16) which is formed in the holder body (12) and the nozzle body and which serves as a fuel infeed, wherein the flow passage (24) is connected to the needle guide (16).

13. Injection valve in accordance with claim 12, characterized in that the valve body (20) of the switching valve (10) closes off the one end of the section of the needle guide (16) which is formed in the holder body (12) and bounds with the end side of the nozzle needle which protrudes into the holder body (12) a high pressure chamber (22) which is in connection with the flow passage (24).

14. A switching valve for use with an injection valve of an internal combustion engine, said switching valve including a work space, said switching valve comprising:

a valve body defining a flow passage, a first end of said flow passage opening into said work space;

a valve plate disposed in said work space, said valve plate being moveable between a closure position and an opening position;

a closure element disposed between the valve plate and said first end of said flow passage, said closure element sealingly engaging said first end of said flow passage when said valve plate is in said closure position; and at least one resilient element disposed within said work space, said at least one resilient element normally biasing the valve plate into said closure position.

15. The switching valve in accordance with claim 14, wherein the closure element is a valve ball.

16. The switching valve in accordance with claim 15, wherein a recess is disposed within the valve plate.

17. The switching valve in accordance with claim 16, wherein at least one of the recess and the opening of the flow passage is conically widened.

18. The switching valve in accordance with claim 16, wherein the depth of the recess is greater than the stroke of the valve plate.

19. The switching valve in accordance with claim 14, wherein the valve plate is held by a compression spring in its closure position and can be moved into its opening position by means of an actuator.

* * * * *